US008454766B2

(12) United States Patent
Mori et al.

(10) Patent No.: US 8,454,766 B2
(45) Date of Patent: Jun. 4, 2013

(54) EXTRUDED MATERIAL OF A FREE-CUTTING ALUMINUM ALLOY EXCELLENT IN EMBRITTLEMENT RESISTANCE AT A HIGH TEMPERATURE

(75) Inventors: Kensuke Mori, Tokyo (JP); Kazuo Taguchi, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 0 days.

(21) Appl. No.: 12/059,904

(22) Filed: Mar. 31, 2008

(65) Prior Publication Data

US 2008/0187456 A1 Aug. 7, 2008

Related U.S. Application Data

(63) Continuation of application No. PCT/JP2006/319565, filed on Sep. 29, 2006.

(30) Foreign Application Priority Data

Sep. 30, 2005 (JP) ..... 2005-288765

(51) Int. Cl.
*C22C 21/00* (2006.01)
*C22C 21/12* (2006.01)

(52) U.S. Cl.
USPC ..... 148/416; 420/554; 420/537; 420/538

(58) Field of Classification Search
USPC ..... 148/416; 420/529, 554, 537, 538
See application file for complete search history.

(56) References Cited

U.S. PATENT DOCUMENTS

| | | | | |
|---|---|---|---|---|
| 1,986,826 | A * | 1/1935 | Hopkins | 420/537 |
| 1,986,827 | A | 1/1935 | Hopkins et al. | |
| 5,286,445 | A * | 2/1994 | Kamiya | 420/530 |

FOREIGN PATENT DOCUMENTS

| | | | |
|---|---|---|---|
| DE | 39 13 537 | A1 | 10/1990 |
| JP | 60-187654 | A | 9/1985 |
| JP | 62-235436 | A | 10/1987 |
| JP | 01-283338 | A | 11/1989 |
| JP | 02-085331 | A | 3/1990 |
| JP | 03-188238 | A | 8/1991 |
| JP | 2726444 | B2 | 12/1997 |
| JP | 2000-234135 | A | 8/2000 |
| JP | 2000234135 | A * | 8/2000 |
| JP | 2006-341307 | A | 12/2006 |
| WO | 01/06027 | A1 | 1/2001 |

OTHER PUBLICATIONS

"Aluminum and Aluminum alloys" ASM International, 1993, p. 20,21,43,45.*

Search Report dated Nov. 21, 2006 issued in corresponding International Application No. PCT/JP2006/319565.

(Continued)

*Primary Examiner* — Roy King
*Assistant Examiner* — Janelle Morillo
(74) *Attorney, Agent, or Firm* — Westerman, Hattori, Daniels & Adrian, LLP

(57) ABSTRACT

An extruded material of a free-cutting aluminum alloy excellent in embrittlement resistance at a high temperature, containing from 3 to 6% by mass of Cu and from 0.9 to 3% by mass of Bi with the balance being Aluminum and inevitable impurities, wherein a temperature for reducing the Charpy impact test value to half of the value at room temperature is 180° C. or more.

8 Claims, 3 Drawing Sheets

OTHER PUBLICATIONS

Forms PCT/IB/308 dated May 3, 2007 and the cover sheet of WO Publication 2007/037426 issued in corresponding International Application No. PCT/JP2006/319565.

Concise explanation of document for Japanese Patent No. 2726444.

Podgornik, A. et al; "Der Einfluss dder oberflaechenspannung auf Groesse und Verteilung von spanbrechenden einschluessen bei Legierungen vonTyp AlCu5(Pb)(Bi).= Influence of surface tension on the size and distribution of the chip-breaking elements in the alloy AlCU(Pb)(Bi)"; Aluminium, Aluminium Verlag, Duesseldorf, De, vol. 47, No. 9, Jan. 1, 1971, pp. 554-556, XP 002050754.

European Search Report dated May 8, 2009, issued in corresponding European Patent Application No. 06810929.7.

Podgornik, V. A. et al., "Influence of surface tension on the size and distribution of the chip-breaking elements in the alloy AlCu(Pb)(Bi)" (Der Einfluss der oberflachenspannung auf Grosse und Verteilung von spanbrechenden Einschlussen bei Legierungen vom Typ AlCu5(Pb)(Bi)), Aluminium, Jan. 1, 1971, pp. 554-556, vol. 47, No. 9, XP 002050754, Aluminium Verlag, Duesseldorf, Germany.

* cited by examiner

Sample A : Conventional free-cutting alloy (containing Sn-Bi)-T3
Sample B : Alloy according to this invention (containing 1.0%Bi)-T3
Sample C : Alloy according to this invention (containing 1.5%Bi)-T3

Sample A : Conventional free-cutting alloy (containing Sn-Bi)-T3
Sample B : Alloy according to this invention (containing 1.0%Bi)-T3
Sample C : Alloy according to this invention (containing 1.5%Bi)-T3

EXTRUDED MATERIAL OF A FREE-CUTTING ALUMINUM ALLOY EXCELLENT IN EMBRITTLEMENT RESISTANCE AT A HIGH TEMPERATURE

TECHNICAL FIELD

The present invention relates to an extruded material of a free-cutting aluminum alloy, to which Pb is not added, with good cuttability (machinability).

BACKGROUND ART

Since aluminum alloys are easy for cutting, they are used for shaft bearings, optical parts and automobile parts by taking advantage of this characteristic. Processability of chips (machining debris) is regarded as important in cutting the aluminum alloy, and it is desirable that the machining debris is cut into small pieces without forming long continuous stripes. However, the chips are hardly cut into pieces due to gentle collision between the chips and a cutting blade in recent years since a rake angle is provided on the cutting blade so that the surface roughness of a product is reduced in cross feed cutting.

Aluminum alloys with good cuttability that have been used conventionally include extruded materials of JIS 2011 alloy produced by adding Pb and Bi to an Al—Cu alloy and JIS 6262 alloy produced by adding Pb and Bi to an Al—Mg—Si alloy. However, aluminum alloys having good cuttability without adding Pb have been required in recent years, in light of environmental problems. Accordingly, alloys prepared by adding Sn and Bi without adding Pb has been proposed as substitutes for the JIS 2011 alloy (prepared by adding Pb and Bi), and free-cutting aluminum alloys having performance approximately equivalent to JIS 2011 alloy in cuttability (machinability) and corrosion resistance are being distributed in the market (Japanese Patent Publication No. 2726444).

However, it was a problem of these conventional free-cutting alloys that machined materials are cracked under heavy cutting conditions, such as high speed cutting. This problem is caused by embrittlement of the alloy since the machined material is heated to a temperature of as high as 135° C. or more due to the heat generated by cutting. The embrittlement of the alloy occurs at near an eutectic temperature among the added elements, and may be confirmed by measuring temperature dependency of Charpy impact test values. It may be also apprehended that the product formed by cutting may arise a brittle rupture in use at a high temperature.

The Sn—Bi-series free-cutting aluminum alloy may arise cracking in a pointing step before die drawing or in the die drawing step in the production process of the alloy as well as during cutting, to thereby induce reduction of productivity.

While these tendencies were observed in the Pb—Bi containing free-cutting aluminum alloy, they were more remarkable in the Sn—Bi containing free-cutting aluminum alloy that uses no Pb.

DISCLOSURE OF INVENTION

In view of the above-mentioned situations, one aspect of the present invention contemplates for providing an extruded material of the free-cutting aluminum alloy, even if Pb is not added, in the Al—Cu-series alloy, that is able to maintain desirable cuttability and is able to suppress embrittlement at a high temperature.

According to the present invention, there is provided the following means:

(1) an extruded material of a free-cutting aluminum alloy excellent in embrittlement resistance at a high temperature, comprising from 3 to 6% by mass of Cu and from 1 to 3% by mass of Bi with the balance being Aluminum and inevitable impurities, wherein a temperature for reducing the Charpy impact test value to half of the value at room temperature is 180° C. or more: and (2) the extruded material of a free-cutting aluminum alloy excellent in embrittlement resistance at a high temperature, further comprising one or two kinds of elements selected from Si in a proportion from 0.1 to 1.5% by mass and Fe in a proportion from 0.1 to 2.0% by mass.

Other and further features and advantages of the invention will appear more fully from the following description, appropriately referring to the accompanying drawing.

BEST MODE FOR CARRYING OUT THE INVENTION

Figure 1:
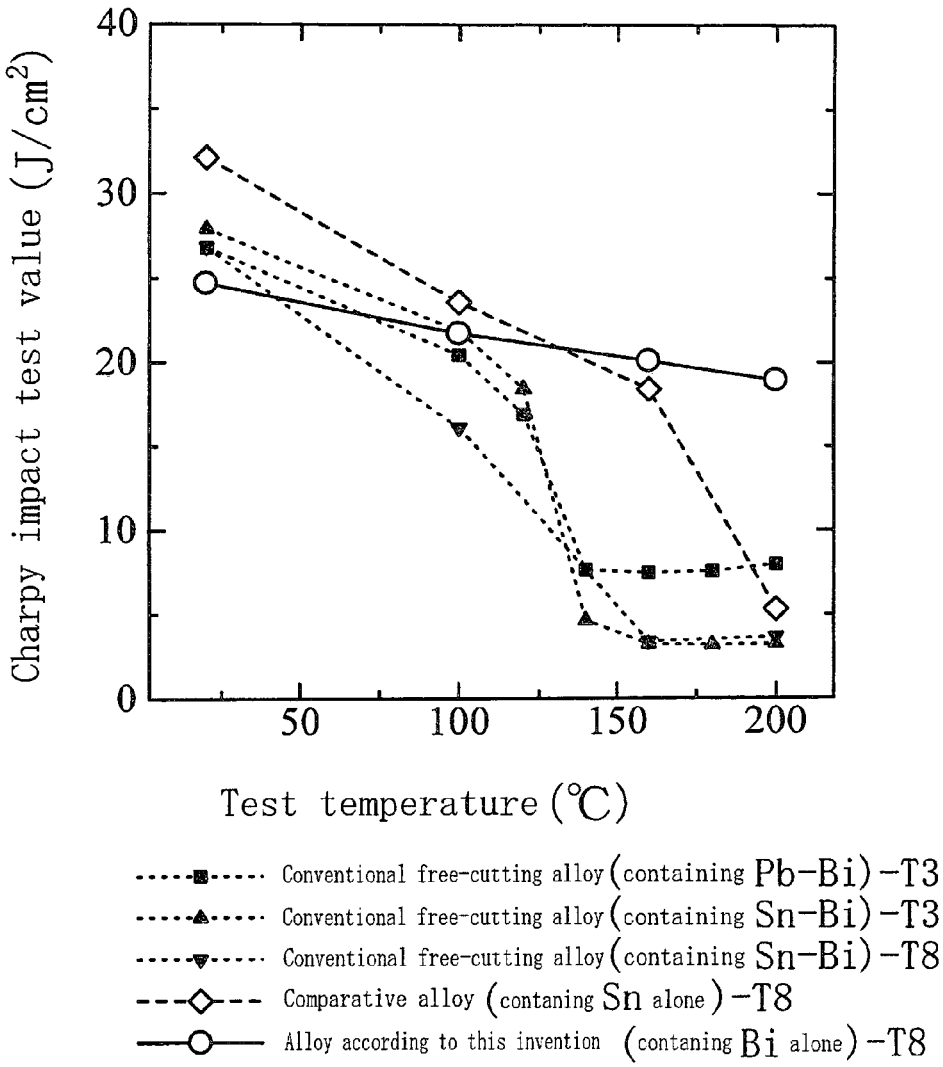
FIG. 1 is a graph showing relations between temperatures and Charpy impact test values in the alloys of examples, comparative examples and the conventional examples.

Hereinafter, the embodiment of the present invention will be explained in detail.

The role of each element added in the free-cutting aluminum alloy according to the present invention will be described first.

Copper (Cu) is an element for improving mechanical strength of the aluminum alloy, by forming a compound, such as $CuAl_2$. The content of copper in the aluminum alloy is from 3.0 to 6.0% by mass, preferably from 5.0 to 6.0% by mass. The effect is small in the range below the lower limit of the content of Cu, and the quality of the surface of the ingot decreases in the range above the upper limit of the content of Cu, so that a good extruded material of the aluminum alloy cannot be obtained.

While silicon (Si) is not an essential element to be added in the present invention, it may be contained for improving mechanical strength of the alloy, and the content is preferably from 0 to 1.5% by mass. However, a good extruded material of the aluminum alloy cannot be obtained when the content exceeds 1.5% by mass since the quality of the surface of the ingot decreases.

While iron (Fe) is also not an essential element to be added in the present invention, it may be contained for improving mechanical strength of the alloy. The strength of the alloy is enhanced by forming an Al—Fe base compound in the aluminum alloy by adding Fe, and cuttability of the extruded material is improved. However, a content of exceeding 2.0% by mass is not preferable since deterioration of the cutting bite is accelerated. The content is preferably from 0 to 2.0% by mass, more preferably from 0.05 to 1.0% by mass.

Chip splittability of the extruded material of the alloy is improved by adding bismuth (Bi). The content of Bi in the alloy is from 0.9 to 3.0% by mass, preferably from 1.0 to 1.5% by mass.

Low-melting-point metals, such as lead (Pb), tin (Sn) and bismuth (Bi) mutually form and exist as compounds in the conventional Pb—Bi containing alloy and Sn—Bi containing alloy since these metals hardly form solid solutions in the aluminum. It is assumed that chip splittability is improved because these compounds melt at the tip of a cutting or drilling blade due to heat in working, to generate notches on the chips. Since the melting points of the Pb—Bi compound and Sn—Bi compound are as low as 125° C. and 139° C., respectively, in the case of the conventional free-cutting aluminum alloy, chip splittability may be readily exhibited by allowing the compounds to melt by heat in working. On the other hand, the compounds serve for rendering the alloy brittle at high temperatures due to their low melting point.

On the contrary, in the case of the extruded material of the free-cutting aluminum alloy of the present invention, Bi is added alone in the Al—Cu-series alloy. The melting point of Bi is 271° C., which is higher than the melting points of the Pb—Bi compound and Sn—Bi compound. Although chip splittability of the Bi-containing alloy is inferior to that of the Pb—Bi containing alloy and Sn—Bi containing alloy, chip splittability of the alloy according to the present invention is still excellent since pure Bi is finely dispersed in the alloy, and the alloy is enough for use as a free-cutting alloy. The alloy according to the present invention is hardly embrittled at high temperatures due to high melting point of Bi. Accordingly, the extruded material of the free-cutting aluminum alloy of the present invention can be useful as a free-cutting aluminum alloy that uses no Pb in place of the Sn—Bi containing alloy that involves the problem of embrittlement at high temperatures. However, the alloy containing less than 0.9% of Bi is poor in chip splittability since Bi is not sufficiently dispersed. While chip splittability is improved by the dispersion effect of Bi when the content of Bi is increased, a good extruded material of the aluminum alloy cannot be obtained due to worsening of castability (roughening of the skin of the cast ingot) when the content of Bi exceeds 3.0% by mass.

The extruded material of the free-cutting aluminum alloy of the present invention is hardly embrittled at high temperatures. Specifically, the Charpy impact test value of the free-cutting aluminum alloy of the present invention does not rapidly decrease at a high temperature in the range from 120 to 200° C. as in the conventional free-cutting aluminum alloy containing Sn—Bi or Pb—Bi.

More specifically, in the extruded material of the free-cutting aluminum alloy of the present invention, the temperature for lowering the Charpy impact test value to half of the value at room temperature is 180° C. or more, and it is preferable that the Charpy impact test value decreases to half of the value at room temperature at around 300° C.

The room temperature is defined to be 25° C. in the present specification and claims.

The extruded material of the free-cutting aluminum alloy of the present invention may contain at least one or two of nickel (Ni), chromium (Cr), zirconium (Zr) and manganese (Mn) in an amount as small as the effect of the present invention is not impaired. The extruded material of the free-cutting aluminum alloy of the present invention may contain a small quantity of zinc (Zn) and titanium (Ti).

While chip splittability is improved by adding Ni since Ni compounds are formed in the alloy, coarse compounds tend to be easily formed when the amount of addition is too large, and mechanical strength and toughness may be decreased.

While adding Cr, Zr and Mn is effective for improving mechanical strength and toughness by fining recrystallized grains of the alloy, the mechanical strength and toughness are rather decreased when the amount to be added is too large since coarse compounds are formed. While addition of Ti is also effective for improving the mechanical strength and toughness of the alloy by fining the cast structure, mechanical strength and toughness are rather decreased when the amount to be added is too large since coarse compounds are formed.

While magnesium (Mg) may be added for improving mechanical strength of the alloy, the content is preferably 1.8% by mass or less. Since Mg forms a Mg—Bi compound having a high melting point, Bi is not effectively used as a low melting point element to impair chip splittability.

Production conditions and tempering conditions of the alloy according to the present invention may be selected, under the usual production conditions, depending on the uses of the alloy. For example, the alloy may be T1 temper by a hot-processing finish; T6 temper by applying solution heat treatment and artificial aging; and T8 or T9 temper by applying solution heat treatment, cold-processing, and artificial aging. Further, tempers like T3, T8, and T9, in which the alloy is subjected to cold-processing or artificial aging after solution heat treatment are also preferable, since chip splittability becomes better when the mechanical strength is greater.

The extruded material of the free-cutting aluminum alloy of the present invention is excellent in embrittlement resistance at a high temperature, and is excellent in corrosion resistance, as well as being able to have cuttability that is equal to the conventional free-cutting alloy, such as JIS 2011 alloy, even if Pb is not added, in the Al—Cu-series alloy.

EXAMPLES

The present invention will be described in more detail based on examples given below.

The alloys with the compositions, as shown in Table 1, were melted, and ingots of diameter 220 mm were obtained from the respective molten alloys. These ingots were heated for homogenization at 480° C. for 6 hours. Extrusion rods of diameter 35 mm were obtained by extruding these ingots at 400° C. Then, after solution heat treatment at 500° C. for 2 hours, the rods were immediately quenched with water. The quenched rods were further formed into rods with a diameter of 30 mm by die drawing to obtain tempered materials as shown in Table 1 after a predetermined aging treatment. The aging condition in T8 treatment was at 160° C. for 14 hours.

The extruded material of the test alloy thus obtained was subjected to cutting test, corrosion resistance test and Charpy impact test.

(1) Cutting Test

The extruded material of the test alloy was subjected to a cutting test by external cutting. Cutting conditions were a rotation speed of 2000 rpm, a cut depth of 1 mm and a feed rate of 0.04 mm/rev.

(2) Embrittlement Resistance at a High Temperature

The extruded material of the test alloy was subjected to a Charpy impact test at a predetermined temperature range from room temperature to 200° C.

(3) Corrosion Resistance Test

The extruded material of the test alloy was subjected to a salt spray test prescribed in JIS 2371 for 200 hours, and the rate of weight loss and the depth of corrosion pits were measured.

(4) Measurement of Hardness

The extruded material of the test alloy was subjected a Vickers hardness test with a load of 5 kg.

The results of the cutting test are shown in Table 1. While chip splittability was evaluated by measuring the weight per 100 pieces of the chip and visually observing the shape of the chip, chip splittability was finally judged by the results of visually observing the shape of the chip. The criteria of judgment by visually-observing were as follows: ◎ (the chip is fine and very good), ○ (the length of the chip is rather short and close to the length of the chip of the conventional free-cutting alloy), Δ (the length of the chip is relatively long) and x (the chip is hardly fragmented and joined to one another). As is apparent from the results in Table 1, chip splittabilities of the alloys No. 1 to 7 according to the present invention into which only Bi was added was almost equal to chip splittabilities of the Sn—Bi containing alloys (conventional free-cutting alloys 8 and 8') and Pb—Bi containing alloys (conventional free-cutting alloys 9 and 9'). When the alloy contains a minute amount of Pb or Sn as in the alloys 4, 4', 5 and 5' according to the present invention, the alloy falls within the range of the present invention so long as the content is about 0.01% or less.

On the other hand, chip splittabilities of comparative alloys No. 10 to 15, 18 and 19 were each poor due to insufficient amount of dispersed Bi in the alloy since the content of Bi is less than 0.9% by mass as the lower limit defined in the present invention. Further, chip splittabilities of comparative alloys No. 16 to 18 were each poor due to insufficient strength of the alloy since the content of Cu is less than 3.0% by mass as the lower limit defined in the present invention.

Next, the results of the Charpy impact test value are shown in FIG. 1. While the Charpy impact test value drastically decreases at around 130° C. in the conventional free-cutting alloys (Sn—Bi containing alloy and Pb—Bi containing alloy), no remarkable decrease of the impact test value was observed in the alloy according to the present invention (the alloy containing Bi alone) and comparative alloy (the alloy containing Sn alone) up to higher temperatures. While the temperature for decreasing the Charpy impact test value to half of the value at room temperature was 170° C. in the alloy containing Sn alone, the Charpy impact test value did not decrease to half of the value at room temperature in the temperature range up to 200° C. in the alloy containing Bi alone. This shows that the alloy containing Bi alone is particularly durable to embrittlement at a high temperature.

TABLE 1

| | | Chemical composition | | | | | | | | | |
|---|---|---|---|---|---|---|---|---|---|---|---|
| | No. | Si | Fe | Cu | Mn | Mg | Cr | Zn | Ti | Zr | Ni |
| Extruded material of the alloy of this invention | 1 | 0.19 | 0.32 | 5.49 | 0.01 | 0.00 | 0.00 | 0.01 | 0.01 | 0.00 | 0.00 |
| | 1' | 0.19 | 0.32 | 5.49 | 0.01 | 0.00 | 0.00 | 0.01 | 0.01 | 0.00 | 0.00 |
| | 2 | 0.16 | 0.24 | 5.63 | 0.00 | 0.00 | 0.00 | 0.01 | 0.01 | 0.00 | 0.00 |
| | 2' | 0.16 | 0.24 | 5.63 | 0.00 | 0.00 | 0.00 | 0.01 | 0.01 | 0.00 | 0.00 |
| | 3 | 0.18 | 0.35 | 5.00 | 0.05 | 0.00 | 0.00 | 0.06 | 0.02 | 0.00 | 0.00 |
| | 3' | 0.18 | 0.35 | 5.00 | 0.05 | 0.00 | 0.00 | 0.06 | 0.02 | 0.00 | 0.00 |
| | 4 | 0.40 | 0.15 | 5.20 | 0.02 | 0.00 | 0.01 | 0.01 | 0.01 | 0.00 | 0.00 |
| | 4' | 0.40 | 0.15 | 5.20 | 0.02 | 0.00 | 0.01 | 0.01 | 0.01 | 0.00 | 0.00 |
| | 5 | 0.12 | 0.12 | 5.80 | 0.01 | 0.00 | 0.00 | 0.01 | 0.01 | 0.00 | 0.00 |
| | 5' | 0.12 | 0.12 | 5.80 | 0.01 | 0.00 | 0.00 | 0.01 | 0.01 | 0.00 | 0.00 |
| | 6 | 1.12 | 0.20 | 3.98 | 0.03 | 0.00 | 0.00 | 0.01 | 0.01 | 0.00 | 0.00 |
| | 7 | 0.20 | 0.19 | 5.54 | 0.40 | 0.00 | 0.04 | 0.01 | 0.01 | 0.05 | 0.00 |
| Extruded material of the conventional free cutting alloy | 8 | 0.10 | 0.20 | 5.10 | 0.00 | 0.00 | 0.00 | 0.00 | 0.00 | 0.00 | 0.00 |
| | 8' | 0.10 | 0.20 | 5.10 | 0.00 | 0.00 | 0.00 | 0.00 | 0.00 | 0.00 | 0.00 |
| | 9 | 0.10 | 0.20 | 5.50 | 0.00 | 0.00 | 0.00 | 0.00 | 0.00 | 0.00 | 0.00 |
| | 9' | 0.10 | 0.20 | 5.50 | 0.00 | 0.00 | 0.00 | 0.00 | 0.00 | 0.00 | 0.00 |
| Extruded material of the comparative alloy | 10 | 0.17 | 0.12 | 5.58 | 0.39 | 0.01 | 0.00 | 0.00 | 0.01 | 0.00 | 0.00 |
| | 11 | 0.77 | 0.70 | 5.07 | 0.38 | 0.10 | 0.00 | 0.00 | 0.00 | 0.00 | 0.00 |
| | 12 | 0.74 | 0.62 | 4.98 | 0.50 | 0.05 | 0.00 | 0.00 | 0.01 | 0.00 | 0.00 |
| | 13 | 0.19 | 0.28 | 5.43 | 0.01 | 0.01 | 0.00 | 0.01 | 0.01 | 0.00 | 0.00 |
| | 14 | 0.18 | 0.35 | 5.00 | 0.00 | 0.00 | 0.00 | 0.02 | 0.02 | 0.00 | 0.00 |
| | 14' | 0.18 | 0.35 | 5.00 | 0.00 | 0.00 | 0.00 | 0.02 | 0.02 | 0.00 | 0.00 |
| | 15 | 1.35 | 0.30 | 3.30 | 0.04 | 0.00 | 0.03 | 0.01 | 0.02 | 0.00 | 0.00 |
| | 16 | 0.50 | 0.17 | 2.85 | 0.02 | 0.00 | 0.01 | 0.03 | 0.01 | 0.00 | 0.00 |
| | 16' | 0.50 | 0.17 | 2.85 | 0.02 | 0.00 | 0.01 | 0.03 | 0.01 | 0.00 | 0.00 |
| | 17 | 0.13 | 0.17 | 2.55 | 0.02 | 0.00 | 0.01 | 0.03 | 0.01 | 0.00 | 0.00 |
| | 17' | 0.13 | 0.17 | 2.55 | 0.02 | 0.00 | 0.01 | 0.03 | 0.01 | 0.00 | 0.00 |
| | 18 | 1.55 | 0.13 | 2.62 | 0.01 | 0.00 | 0.00 | 0.00 | 0.00 | 0.00 | 0.00 |
| | 19 | 0.20 | 0.35 | 5.35 | 0.35 | 0.10 | 0.04 | 0.02 | 0.02 | 0.13 | 0.00 |

| | | Chemical composition | | | | | Weight per 100 pieces of | Evaluation of the shape | Hardness HV5 |
|---|---|---|---|---|---|---|---|---|---|
| | No. | Pb | Sn | Bi | AL | Temper | the chip | of the chip | Average |
| Extruded material of the alloy of this invention | 1 | 0.00 | 0.00 | 1.00 | Balance | T8 | 0.623 | ○ | 122 |
| | 1' | 0.00 | 0.00 | 1.00 | Balance | T3 | 0.698 | ○ | 121 |
| | 2 | 0.00 | 0.01 | 1.58 | Balance | T8 | 0.601 | ○ | 122 |
| | 2' | 0.00 | 0.01 | 1.58 | Balance | T3 | 0.645 | ○ | 116 |
| | 3 | 0.00 | 0.00 | 2.65 | Balance | T8 | 0.476 | ○ | 121 |
| | 3' | 0.00 | 0.00 | 2.65 | Balance | T3 | 0.689 | ○ | 121 |
| | 4 | 0.01 | 0.01 | 1.90 | Balance | T8 | 0.623 | ○ | 124 |
| | 4' | 0.01 | 0.01 | 1.90 | Balance | T3 | 0.633 | ○ | 122 |
| | 5 | 0.01 | 0.00 | 1.49 | Balance | T8 | 0.598 | ○ | 124 |
| | 5' | 0.01 | 0.00 | 1.49 | Balance | T3 | 0.625 | ○ | 122 |
| | 6 | 0.00 | 0.00 | 1.10 | Balance | T4 | 0.642 | ○ | 118 |
| | 7 | 0.00 | 0.00 | 1.50 | Balance | T8 | 0.602 | ○ | — |
| Extruded material of the conventional | 8 | 0.00 | 0.60 | 0.70 | Balance | T3 | 0.292 | ◎ | 110 |
| | 8' | 0.00 | 0.60 | 0.70 | Balance | T8 | 0.610 | ○ | 133 |
| | 9 | 0.50 | 0.00 | 0.50 | Balance | T3 | 0.616 | ○ | 115 |

TABLE 1-continued

| | | | | | | | | | |
|---|---|---|---|---|---|---|---|---|---|
| free cutting alloy | 9' | 0.50 | 0.00 | 0.50 | Balance | T8 | 0.193 | ◎ | 124 |
| Extruded | 10 | 0.00 | 0.01 | 0.08 | Balance | T8 | 2.605 | X | 122 |
| material of the | 11 | 0.00 | 1.00 | 0.00 | Balance | T3 | 0.840 | Δ | 115 |
| comparative | 12 | 0.02 | 0.46 | 0.00 | Balance | T4 | 1.241 | Δ | 134 |
| alloy | 13 | 0.04 | 0.46 | 0.00 | Balance | T8 | 1.180 | Δ | 120 |
| | 14 | 0.00 | 0.00 | 0.07 | Balance | T8 | 2.480 | X | 126 |
| | 14' | 0.00 | 0.00 | 0.07 | Balance | T3 | 2.440 | X | 124 |
| | 15 | 0.00 | 0.00 | 0.04 | Balance | T4 | 2.890 | X | 125 |
| | 16 | 0.00 | 0.00 | 1.12 | Balance | T8 | 0.980 | Δ | 109 |
| | 16' | 0.00 | 0.00 | 1.12 | Balance | T3 | 1.110 | Δ | 108 |
| | 17 | 0.00 | 0.00 | 2.86 | Balance | T8 | 1.860 | Δ | 111 |
| | 17' | 0.00 | 0.00 | 2.86 | Balance | T3 | 1.240 | Δ | 103 |
| | 18 | 0.00 | 0.00 | 0.30 | Balance | T4 | 1.521 | X | — |
| | 19 | 0.00 | 0.00 | 0.42 | Balance | T8 | 0.965 | Δ | — |

Figure 2:
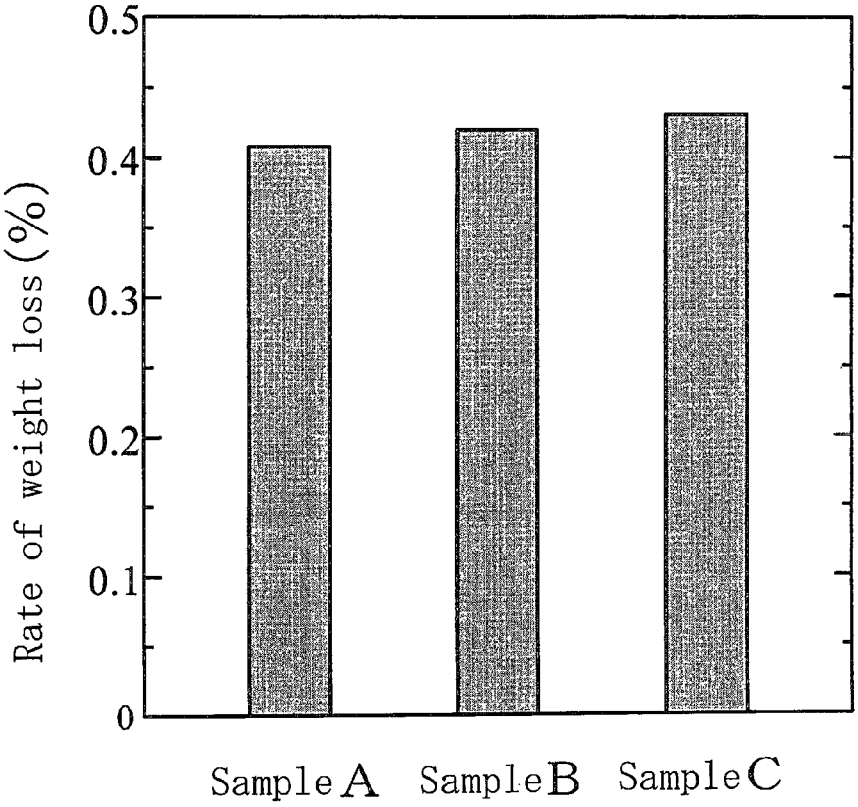
FIG. 2 is a graph showing the results of a salt spray test (weight loss rate) for the alloys of the present invention and the conventional free-cutting alloys.
Figure 3:
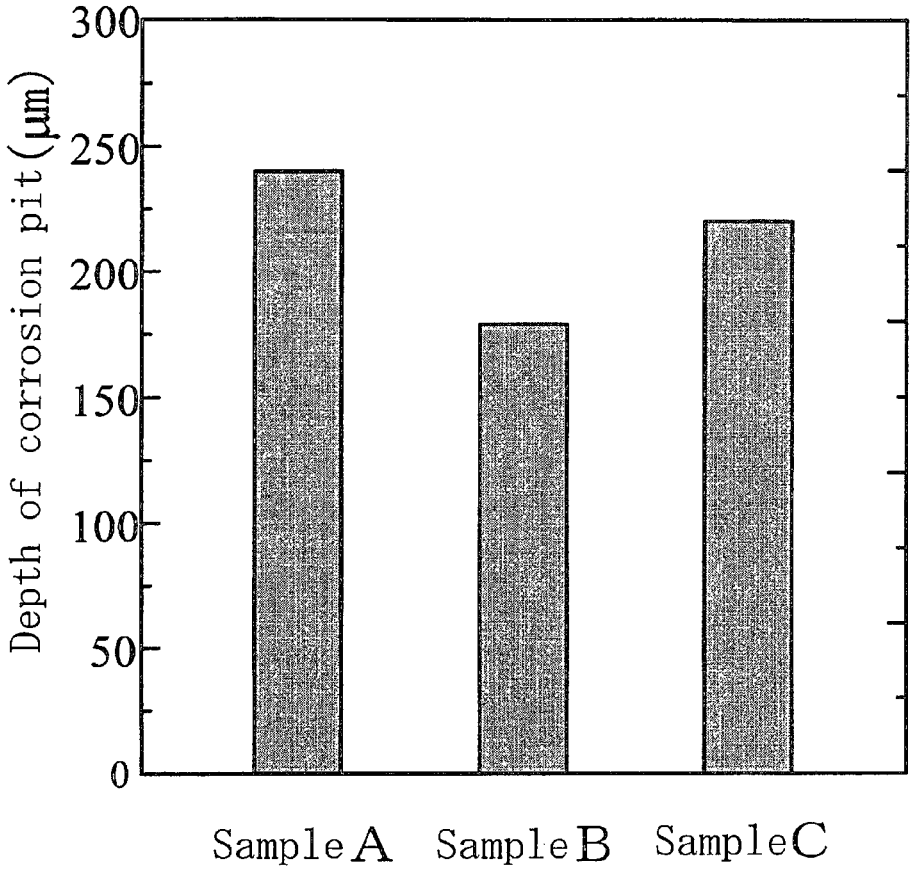
FIG. 3 is a graph showing the results of a salt spray test (depth of corrosion pits) for the alloys of the present invention and the conventional free-cutting alloys.

Next, the results of the corrosion resistance test are shown in FIGS. 2 and 3. FIG. 2 shows the weight loss rate after the salt spray treatment for 200 hours. In FIG. 2, the alloys according to the present invention (the alloy containing 1.0% of Bi alone and the alloy containing 1.5% of Bi alone) showed approximately the same weight loss rate as the conventional free-cutting alloy (containing Sn—Bi), that is, a weight loss rate of about 0.4%. FIG. 3 shows the depth of pits after the salt spray treatment for 200 hours. In FIG. 3, the depth of pits of the alloys (the alloy containing 1.0% of Bi alone and the alloy containing 1.5% of Bi alone) according to the present invention was 300 μm or less.

The results above showed that the extruded material of the free-cutting aluminum alloy of the present invention has equal or superior of corrosion resistance to the conventional free-cutting aluminum alloy.

INDUSTRIAL APPLICABILITY

The extruded material of the free-cutting aluminum alloy of the present invention is useful since it may be used as the free-cutting aluminum alloy without using Pb in place of the Sn—Bi-series alloy that involves problems of embrittlement at high temperatures such as brittle rupture of the machined product due to the heat generated by cutting and occurrence of cracks in the die drawing step in the production process of the alloy.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. An extruded material of a free-cutting aluminum alloy excellent in embrittlement resistance at a high temperature, consisting of:

from 3 to 6% by mass of Cu;
from 0.9 to 3% by mass of Bi;
from 0.1 to 1.12% by mass of Si;
from 0.1 to 0.35% by mass of Fe;
from 0 to 0.06% by mass of Zn;
from 0 to 0.05% by mass of Mn; and
a balance of Al with inevitable impurities,
wherein the extruded material has a extruded structure, and
a temperature for reducing the Charpy impact test value to half of the value at room temperature is 180° C. or more.

2. The extruded material of a free-cutting aluminum alloy according to claim 1, wherein the extruded material contains Si in a proportion from 0.12 to 0.4% by mass.

3. The extruded material of a free-cutting aluminum alloy according to claim 1, wherein the extruded material contains Fe in a proportion from 0.12 to 0.35% by mass.

4. The extruded material of a free-cutting aluminum alloy according to claim 1, wherein the extruded material contains Mn in a proportion from 0.01 to 0.05% by mass.

5. The extruded material of a free-cutting aluminum alloy according to claim 1, wherein the extruded material contains Si in a proportion from 0.12 to 0.4% by mass and Fe in a proportion from 0.12 to 0.35% by mass.

6. The extruded material of a free-cutting aluminum alloy according to claim 1, wherein the extruded material contains Bi in a proportion from 0.9 to 1.5% by mass.

7. An extruded material of a free-cutting aluminum alloy, consisting of:

from 3 to 6% by mass of Cu,
from 0.9 to 3% by mass of Bi,
from 0.1 to 1.12% by mass of Si;
from 0.1 to 0.35% by mass of Fe;
from 0 to 0.06% by mass of Zn,
from 0 to 0.05% by mass of Mn, and
the balance Al and inevitable impurities,
wherein each of Pb and Sn is restricted to 0.01% by mass or less,
wherein a temperature for reducing the Charpy impact test value to half of the value at room temperature is 180° C. or more, and
wherein the extruded material is excellent in embrittlement resistance at a high temperature.

8. An extruded material of a free-cutting aluminum alloy, consisting of:

from 3.98 to 5.80 mass % of Cu,
from 1.00 to 2.65 mass % of Bi,
from 0.12 to 1.12 mass % of Si,
from 0.12 to 0.35 mass % of Fe,
from 0.01 to 0.06 mass % of Zn,
from 0 to 0 to 0.05 mass % of Mn,
from 0.01 to 0.02 mass % of Ti, and
the balance Al and inevitable impurities,
wherein each of Pb and Sn is restricted to 0.01 mass % or less,
wherein a temperature for reducing the Charpy impact test value to half of the value at room temperature is 180° C. or more, and
wherein the extruded material is excellent in embrittlement resistance at a high temperature.

* * * * *